US007722011B1

(12) United States Patent
Edwards

(10) Patent No.: US 7,722,011 B1
(45) Date of Patent: May 25, 2010

(54) JACK EXTENSION SYSTEM

(76) Inventor: Leslie E. Edwards, 323 Railroad St., Groton, VT (US) 05046

( * ) Notice: Subject to any disclaimer, the term of this patent is extended or adjusted under 35 U.S.C. 154(b) by 0 days.

(21) Appl. No.: 12/113,270

(22) Filed: May 1, 2008

(51) Int. Cl.
*B66F 3/00* (2006.01)

(52) U.S. Cl. ..... 254/133 R; 254/134; 254/DIG. 4; 254/100

(58) Field of Classification Search ..... 254/133 R, 254/134, 100, 113, 114, 119, DIG. 4
See application file for complete search history.

(56) References Cited

U.S. PATENT DOCUMENTS

| | | | | | |
|---|---|---|---|---|---|
| 1,410,380 | A * | 3/1922 | Daniels | ..... | 254/133 R |
| 1,477,298 | A * | 12/1923 | Templeton | ..... | 254/133 R |
| 1,482,846 | A * | 2/1924 | Harrah | ..... | 254/133 R |
| 3,073,570 | A | 1/1963 | Harvey | | |
| 3,729,209 | A | 4/1973 | Litz | | |
| 3,779,517 | A | 12/1973 | Fisher | | |
| 4,148,462 | A * | 4/1979 | Jessup | ..... | 254/133 R |
| 4,486,004 | A | 12/1984 | Drewitz | | |
| D461,615 | S | 8/2002 | Bainter | | |
| 6,604,562 | B1 * | 8/2003 | Smith | ..... | 144/34.2 |
| 7,192,007 | B2 * | 3/2007 | Thomas | ..... | 254/133 R |
| 2006/0043718 | A1 | 3/2006 | Mayer | | |
| 2006/0081755 | A1 | 4/2006 | Thorpe | | |
| 2006/0237700 | A1 * | 10/2006 | Thomas | ..... | 254/133 R |

* cited by examiner

*Primary Examiner*—Lee D Wilson

(57) ABSTRACT

A jack extension system includes a mechanical jack that has a vertical support and a foot mounted on the vertical support. The foot is moved upwardly or downwardly on the vertical support. The vertical support has an upper end. A bracket is removably attached to the upper end of the jack. The bracket has an opening extending therethrough. A post has a bottom end and a top end. The bottom end comprises a coupler that is removably attached to the foot. The top end comprises a plate. The post extends through the bracket and the plate is abuttable against an object to be lifted.

1 Claim, 5 Drawing Sheets

JACK EXTENSION SYSTEM

BACKGROUND OF THE-INVENTION

Field of the Invention

The present invention relates to lifting devices and more particularly pertains to a new lifting device for increasing the effective lifting height of a jack.

SUMMARY OF THE INVENTION

The present invention meets the needs presented above by generally comprising a mechanical jack that has a vertical support and a foot mounted on the vertical support. The foot is moved upwardly or downwardly on the vertical support. The vertical support has an upper end. A bracket is removably attached to the upper end of the jack. The bracket has an opening extending therethrough. A post has a bottom end and a top end. The bottom end comprises a coupler that is removably attached to the foot. The top end comprises a plate. The post extends through the bracket and the plate is abuttable against an object to be lifted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
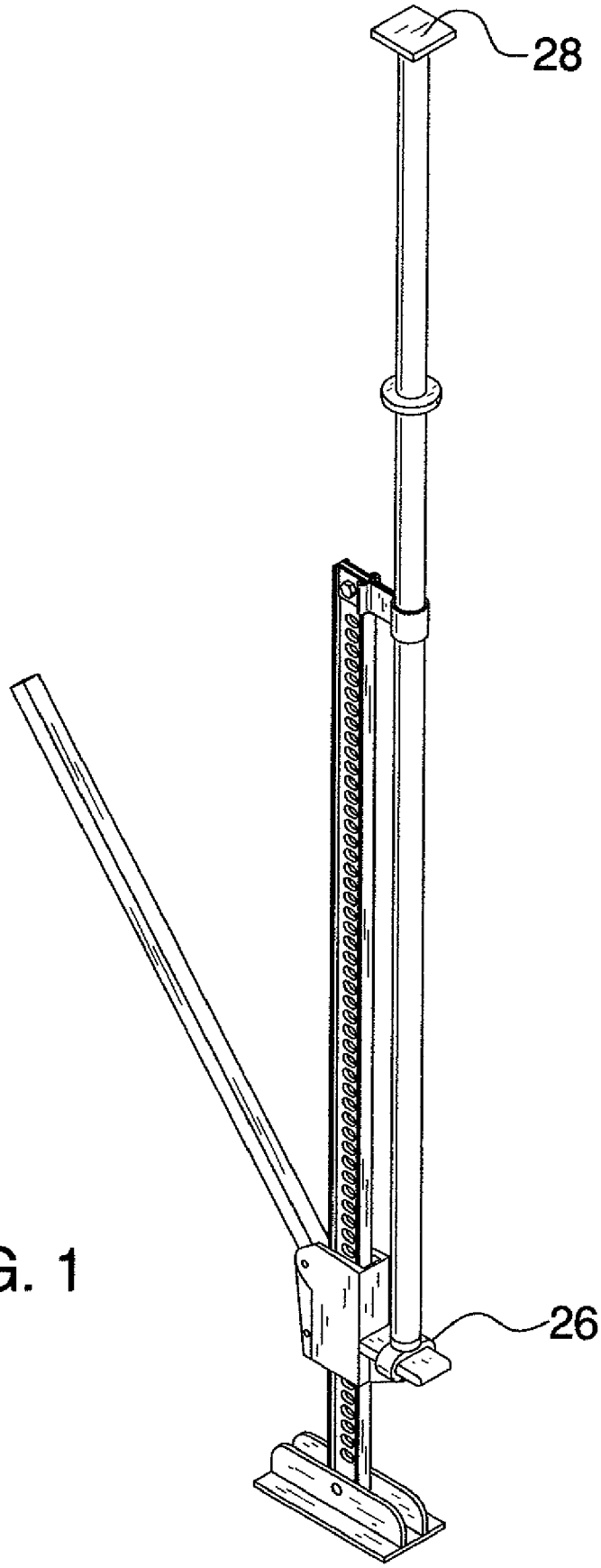
FIG. 1 is a front perspective view of a jack extension system according to the present invention.
Figure 2:
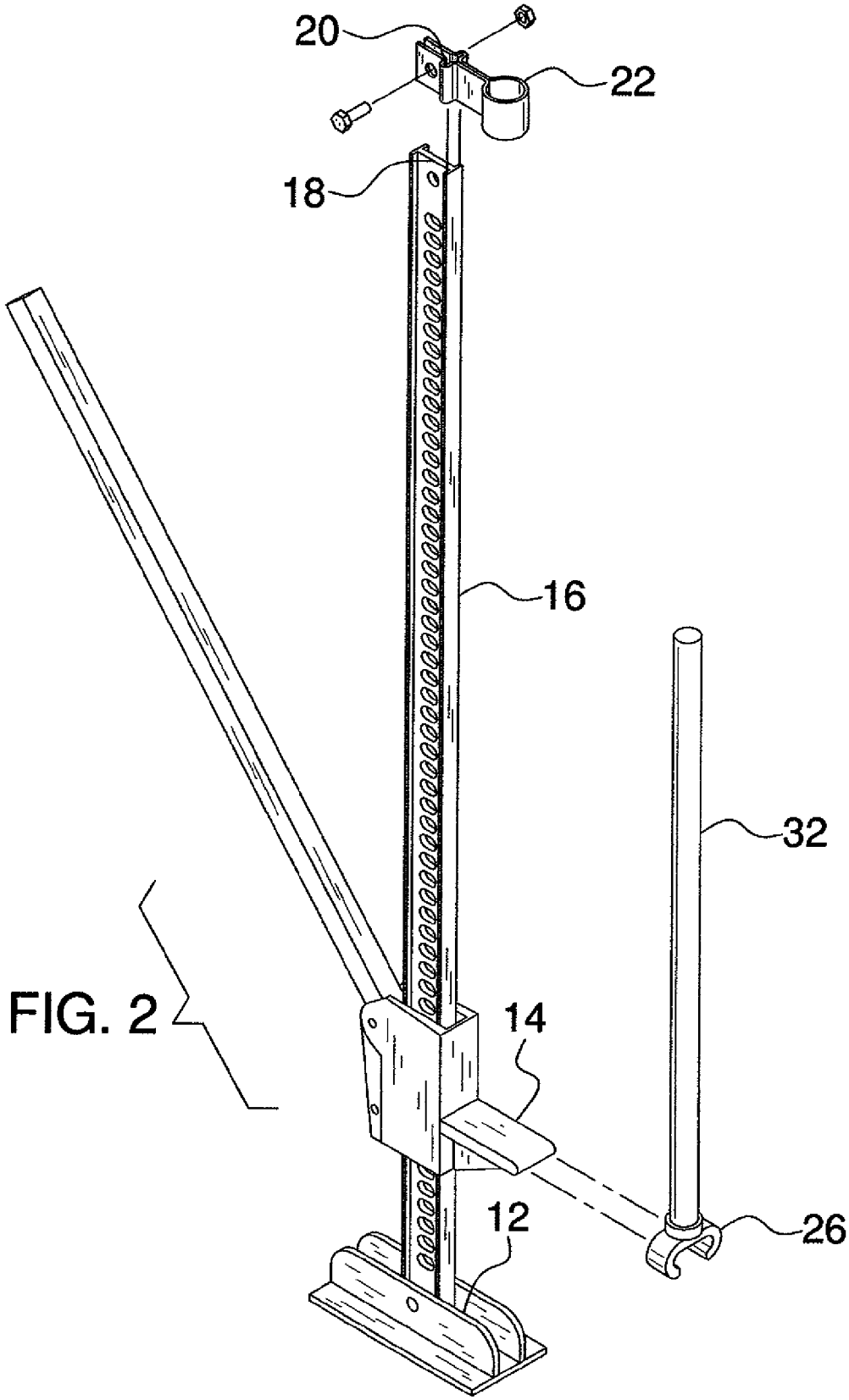
FIG. 2 is an expanded front perspective view of the present invention.
Figure 3:
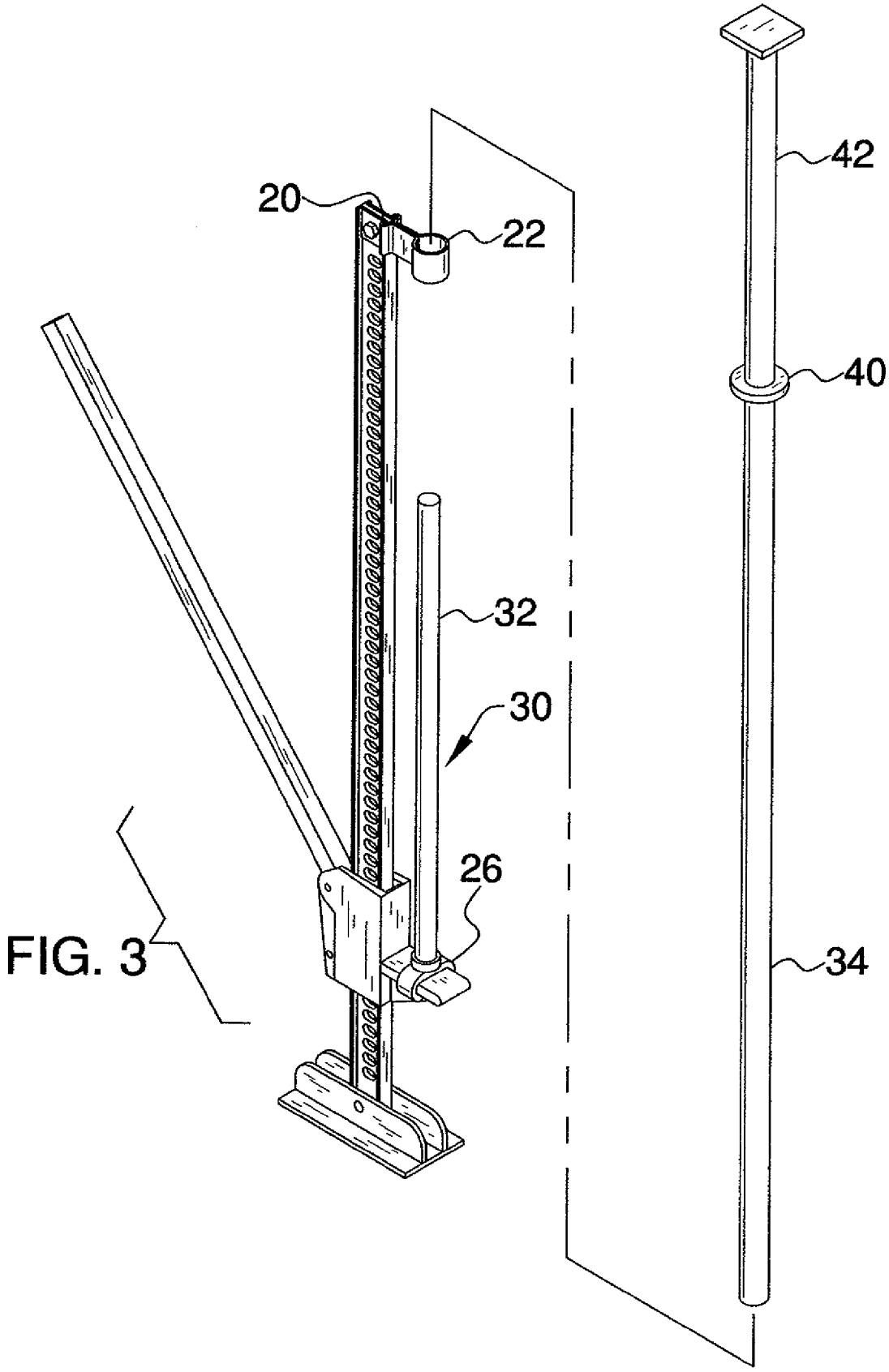
FIG. 3 is an expanded front perspective view of the present invention.
Figure 4:
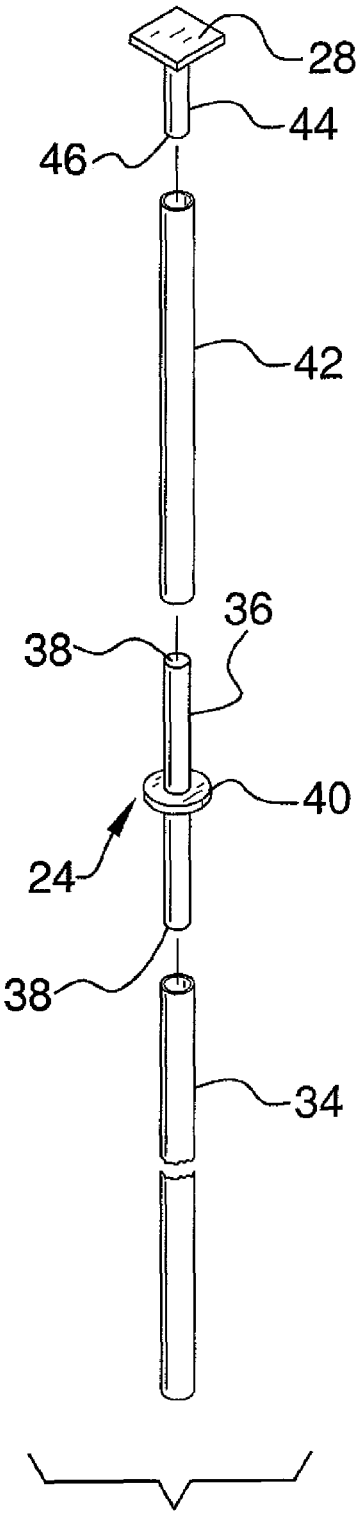
FIG. 4 is an expanded view of a post of the present invention.
Figure 5:
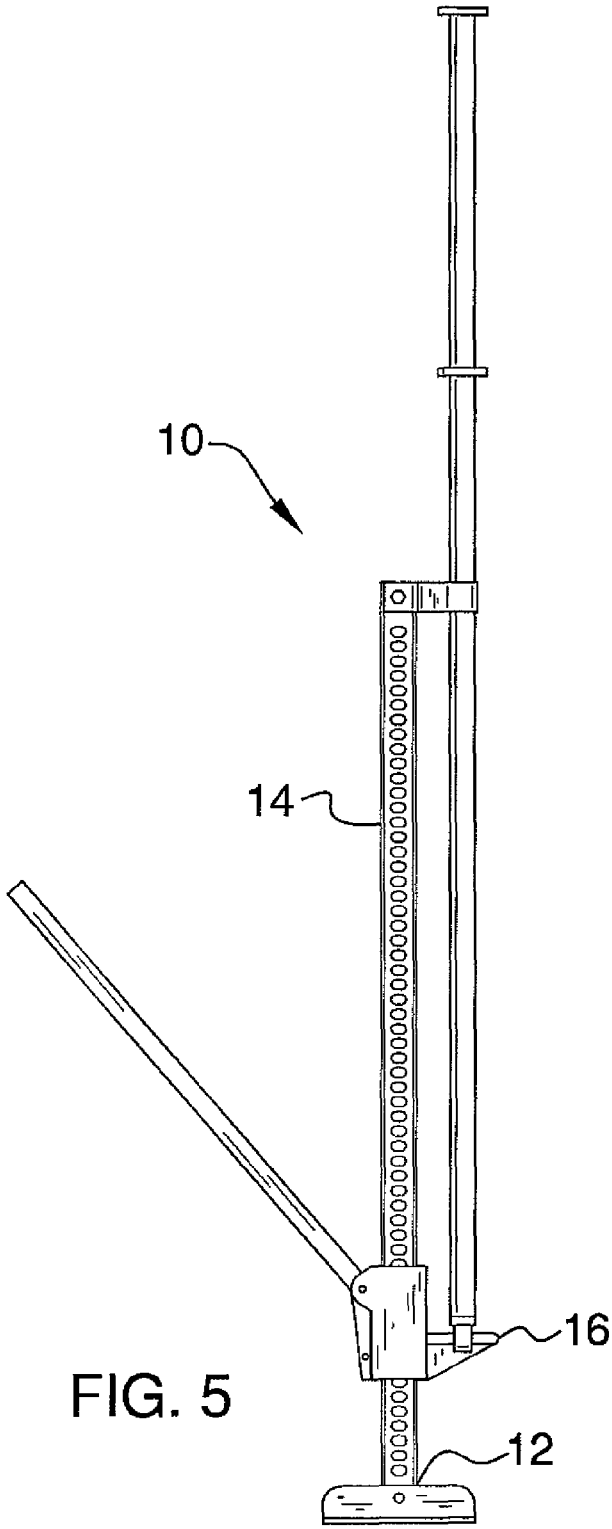
FIG. 5 is a side view of the present invention.
Figure 6:
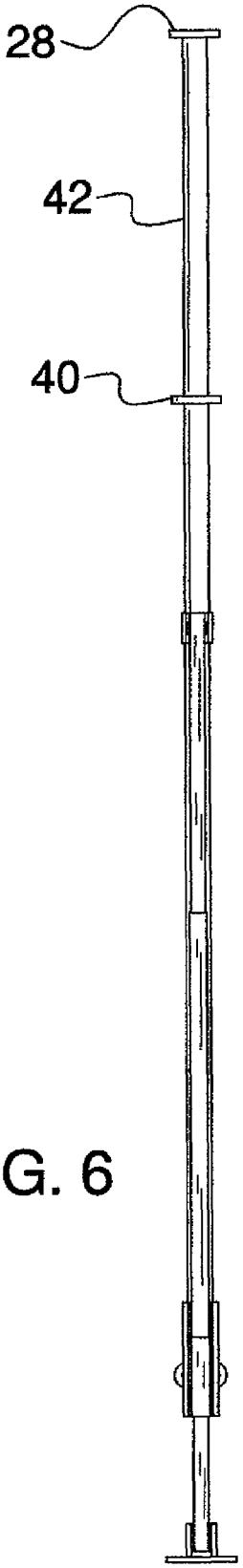
FIG. 6 is a rear view of the present invention.
Figure 7:
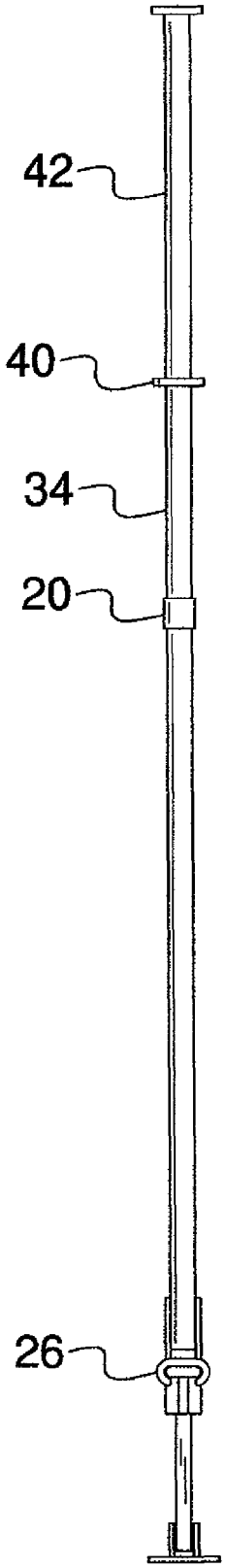
FIG. 7 is a front view of the present invention.

With reference now to the drawings, and in particular to FIGS. 1 through 7 thereof, a new lifting device embodying the principles and concepts of the present invention and generally designated by the reference numeral 10 will be described.

As best illustrated in FIGS. 1 through 7, the jack extension system 10 generally comprises a conventional mechanical jack 12 that includes a vertical support 14 and a foot 16 mounted on the vertical support 14. The foot 16 is moved upwardly or downwardly on the vertical support 14 when the jack 12 is actuated. The vertical support 14 has an upper end 18.

A bracket 20 is removably attached to the upper end 18 of the jack 12. The bracket 20 has an opening 22 extending therethrough. A post 24 has a bottom end and a top end. The bottom end comprises a coupler 26 that is removably attached to the foot 16. The top end comprises a plate 28. The post 24 extends through the bracket 20. The plate 28 is abuttable against an object to be lifted.

The post 24 includes a plurality of sections releasable from each other. The sections include a bottom section 30 that also includes the coupler 26. A rod 32 is attached to and extends upwardly from the coupler 16. A bottom cylinder 34 is provided and the rod 32 extends into the bottom cylinder 34. The bottom cylinder 34 extends through the bracket 20. A bar 36 has a pair of opposite ends 38. A flange 40 is attached to the bar 36 and is positioned between the opposite ends 38. The bar 36 extends into the bottom cylinder 34 and the flange 40 abuts an end of the bottom cylinder 34. An upper cylinder 42 is provided and the bar 36 extends into the upper cylinder 42 and abuts the flange 40. A shaft 44 has the plate 28 attached thereto. The shaft 44 has a distal end 46 with respect to the plate 28. The shaft 44 is extendable into the upper cylinder 42.

In use, when a user of the jack 12 has to lift an object which is raised a distance off of a ground surface where the jack 12 cannot properly reach it, the bracket 20 and the post 24 are mounted on the jack 12 so that the plate 28 may be used to lift the object. The post 24 includes releasable sections so that they may be interchanged as needed to vary the height of the post 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jack extension system comprising:

a mechanical jack including a vertical support and a foot mounted on said vertical support, said foot being moved upwardly or downwardly on said vertical support, said vertical support having an upper end;

a bracket being removably attached to said upper end of said jack, said bracket having an opening extending therethrough;

a post having a bottom end and a top end, said bottom end comprising a coupler, said coupler being removably attached to said foot, said top end comprising a plate, said post extending through said bracket, said plate being abuttable against an object to be lifted, said post including a plurality of sections releasable from each other, said sections including;

a bottom section including said coupler, a rod being attached to and extending upwardly from said coupler;

a bottom cylinder, said rod extending into said bottom cylinder, said bottom cylinder extending through said bracket;

a bar having a pair of opposite ends, a flange being attached to said bar and being positioned between said opposite ends, said bar extending into said bottom cylinder and said flange abutting an end of said bottom cylinder;

an upper cylinder, said bar extending into said upper cylinder and abutting said flange; and a shaft having said plate attached thereto, said shaft having a distal end with respect to said plate, said shaft being extendable into said upper cylinder.

* * * * *